United States Patent [19]

Nakamatsu et al.

[11] 4,173,525

[45] Nov. 6, 1979

[54] ELECTROLYTIC CELL FOR ELECTROLYSIS OF SEA WATER

[75] Inventors: Shuji Nakamatsu, Ichihara; Hiroyuki Harada, Yokohama; Yoshitugu Shinomiya, Tamano; Tuyoshi Omizu, Okayama, all of Japan

[73] Assignee: Chlorine Engineers Corp., Ltd., Tokyo, Japan

[21] Appl. No.: 926,775

[22] Filed: Jul. 21, 1978

[51] Int. Cl.[2] ..... C25B 9/00; C25B 1/26; C25B 11/02

[52] U.S. Cl. ..... 204/275; 204/95; 204/280; 204/289

[58] Field of Search ..... 204/275–278, 204/95, 289, 280

[56] References Cited

U.S. PATENT DOCUMENTS

| | | | |
|---|---|---|---|
| 3,539,486 | 11/1970 | Fleck | 204/95 |
| 3,766,045 | 10/1973 | Itakura et al. | 204/275 |
| 3,884,791 | 5/1975 | Raetzsch et al. | 204/95 X |
| 3,893,902 | 7/1975 | Loftfield et al. | 204/275 X |
| 3,915,817 | 10/1975 | Bennett | 204/275 X |
| 4,075,077 | 2/1978 | Hodges | 204/275 X |

*Primary Examiner*—John H. Mack
*Assistant Examiner*—D. R. Valentine
*Attorney, Agent, or Firm*—Sughrue, Rothwell, Mion, Zinn and Macpeak

[57] ABSTRACT

An electrolytic cell for electrolysis of sea water comprising a housing having an opening at the bottom and top of the housing for in-flow of sea water and out-flow of electrolyzed sea water, respectively;

a plurality of flat plate-like anodes vertically disposed in the housing with the major surface area of the anodes being parallel to the flow of sea water through the cell;

a plurality of flat plate-like cathodes vertically disposed in the housing with the major surface area of the cathodes being parallel to the flow of sea water through the cell;

an outwardly projecting portion for passing an electric current provided at the lower side edge of each of the anodes;

an outwardly projecting portion for passing an electric current provided at the upper side edge of each of the cathodes;

an electric current-passing plate secured to the lower portion of the housing and connected to the portions for passing an electric current to each of the anodes; and an electric current-passing plate secured to the upper portion of the housing and connected to the portions for passing an electric current to each of the cathodes; and wherein the anodes and the cathodes are alternatingly disposed with respect to each other, the side edges of each of the anodes and the side edges of each of the cathodes, except for the portions for passing an electric current of each of the anodes and each of the cathodes, are spaced from the inner wall of the housing, and each of the flat plate-like cathodes and each of the flat plate-like anodes have an external contour such that the external contour of each of the flat plate-like cathodes, except for the portions for passing an electric current to each of the cathodes, is located inwardly of the external contour of each of the flat plate-like anodes.

5 Claims, 5 Drawing Figures

ELECTROLYTIC CELL FOR ELECTROLYSIS OF SEA WATER

BACKGROUND OF THE INVENTION

1. Field of the Invention

This invention relates to an electrolytic cell for electrolysis of sea water.

2. Description of the Prior Art

In the electrolysis of sea water using conventional electrolytic cells, there is the disadvantage that precipitates such as magnesium hydroxide or calcium carbonate deposit on the cathode plate of the electrolytic cell to cause clogging between the electrodes. This leads to a decrease in electrolyte flow rate, an increase in electrolytic cell voltage and a decrease in current efficiency. To remove these precipitates, the operation must be stopped continually and the electrolytic cell must be treated by back washing, acid washing, etc.

Attempts to prevent the deposition of precipitates which causes this problem include, for example, a method which comprises maintaining the rate of passage of sea water through the electrolytic cell at a value sufficient to substantially suspend particulate materials present, and back-washing the cell while stopping the electrolysis (e.g., as disclosed in U.S. Pat. No. 3,893,902), and a method involving the use of an electrolytic cell which has a structure such that on introduction of an electrolytic solution into the cell, the solution first contacts the anode, and before the solution leaves the cell, the solution finally contacts the anode (e.g., as disclosed in U.S. Pat. Nos. 3,819,504 and 3,915,817). These prior art methods, however, still do not completely prevent the deposition of precipitates. Deposition of precipitates is especially heavy at the side edge of the cathode plate and the lower end surface of the cathode which faces a sea water flow inlet, and deposition cannot be effectively prevented by prior art methods.

SUMMARY OF THE INVENTION

An object of the present invention is to provide an electrolytic cell for electrolysis of sea water which has a structure with which deposition of precipitates on the entire cathode plate, especially at the side edge and lower end portion of the cathode, is prevented.

As a result of investigations, it has now been found that the deposition of precipitates on the cathode is especially marked at a portion where the flow of sea water stagnates or at that portion of the cathode surface where the current density is low and the evolution of hydrogen gas is low, and that the precipitates gradually grow on the surface perpendicular to the direction of the flow of sea water. To overcome this disadvantage, the present invention provides an electrolytic cell in which flat plate-like anodes and flat plate-like cathodes are disposed parallel to each other in the vertical direction so that the flow of sea water will not stagnate over the entire surface of the cathode. Furthermore, according to this invention, portions of the electrolytic cell where deposition of precipitates tends to occur, such as at the side edge of the cathode plate and at the lower end surface of the cathode facing a sea water flow inlet, have a structure such that flow of sea water does not stagnate there, and a stirring effect due to liquid and gas is increased. A most suitable means for passing an electric current is also provided.

The present invention thus provides an electrolytic cell for electrolysis of sea water comprising a housing having an opening at the bottom and top of the housing for in-flow of sea water and out-flow of electrolyzed sea water, respectively;

a plurality of flat plate-like anodes vertically disposed in the housing with the major surface area of the anodes being parallel to the flow of sea water through the cell;

a plurality of flat plate-like cathodes vertically disposed in the housing with the major surface area of the cathodes being parallel to the flow of sea water through the cell;

an outwardly projecting portion for passing an electric current provided at the lower side edge of each of the anodes;

an outwardly projecting portion for passing an electric current provided at the upper side edge of each of the cathodes;

an electric current-passing plate secured to the lower portion of the housing and connected to the portions for passing an electric current to each of the anodes; and an electric current-passing plate secured to the upper portion of the housing and connected to the portions for passing an electric current to each of the cathodes; and wherein the anodes and the cathodes are alternatingly disposed with respect to each other, the side edges of each of the anodes and the side edges of each of the cathodes, except for the portions for passing an electric current of each of the anodes and each of the cathodes, are spaced from the inner wall of the housing, and each of the flat plate-like cathodes and each of the flat plate-like anodes have an external contour such that the external contour of each of the flat plate-like cathodes, except for the portions for passing an electric current to each of the cathodes, is located inwardly of the external contour of each of the flat plate-like anodes.

BRIEF DESCRIPTION OF THE DRAWINGS

The invention will be described below by reference to the accompanying drawings in which.

DETAILED DESCRIPTION OF THE INVENTION

Figure 1:
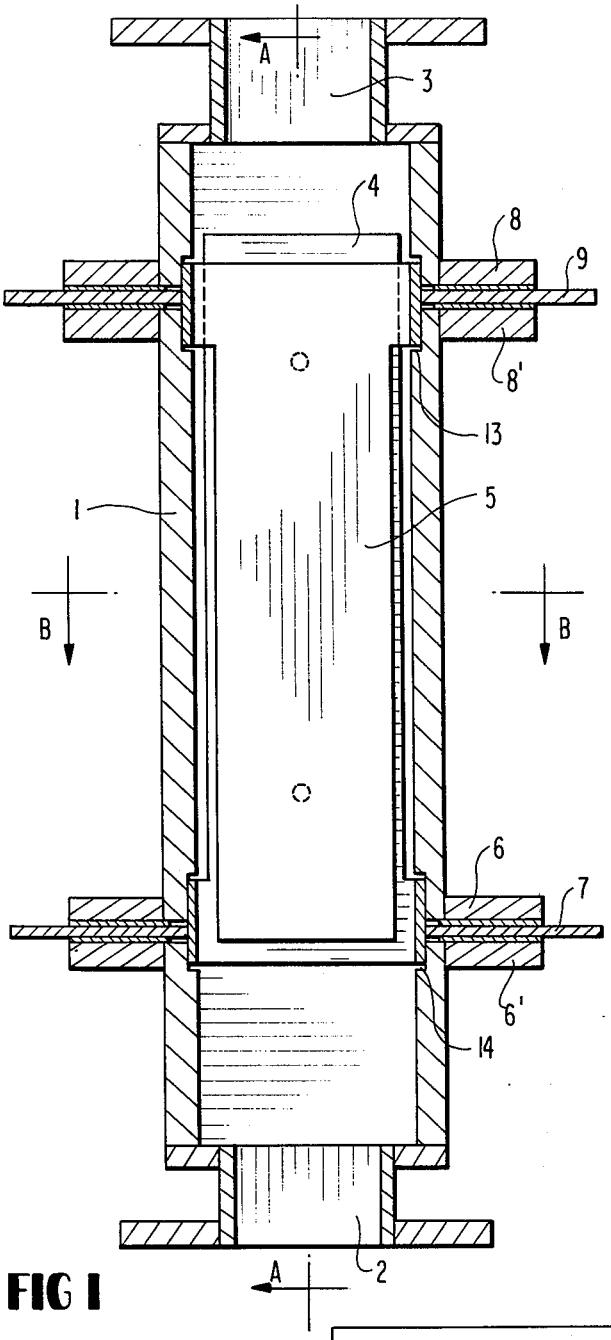
FIG. 1 is a vertical sectional view of one embodiment of the electrolytic cell for electrolysis of sea water in accordance with this invention.
Figure 2:
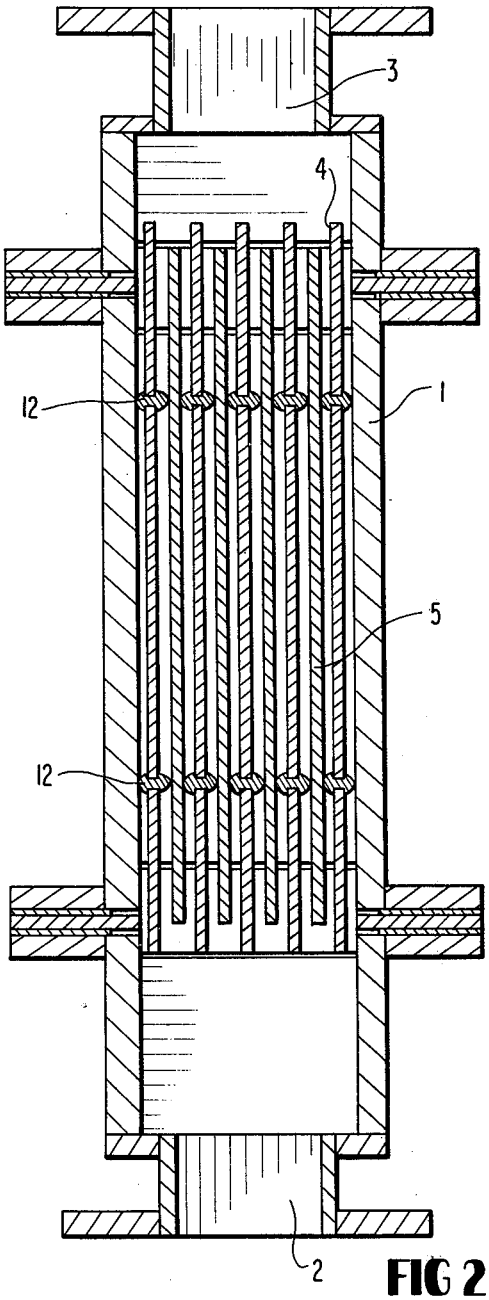
FIG. 2 is a sectional view taken along the line A—A of FIG. 1.
Figure 3:
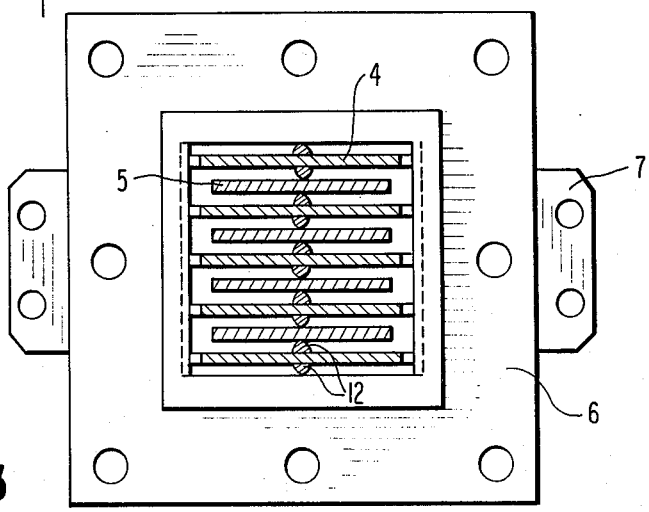
FIG. 3 is a sectional view taken along the line B—B of FIG. 1.

In FIGS. 1 to 3, reference numeral 1 represents a housing of an electrolytic cell which has a sea water flow inlet 2 at the lower portion of the housing and an electrolyte solution flow outlet 3 at the upper portion of the housing. Within the housing of the electrolytic cell are disposed flat plate-like anodes 4 and flat plate-like cathodes 5 parallel to each other in the vertical direction. Each flat plate-like anode may be made of a mesh-like plate, a perforated plate, a non-perforated plate, etc. However, the flat plate-like cathode is a non-perforated plate, having an even surface because a cathode with an uneven surface such as a mesh plate or a perforated plate tends to permit deposition of precipitates.

Suitable materials for the anode are, for example, valve metal (a film-forming metal, e.g., titanium, tantalum, niobium, hafnium and zirconium) coated with a platinum-group metal or with a layer comprising a platinum-group metal oxide in addition to, if necessary, $TiO_2$, $SnO_2$ and other various types of oxides, and materials for the cathode are, for example, titanium, stainless steel, Hastelloy, nickel, or a chrome-plated steel sheet.

In order to prevent the electrolyte solution from stagnating near the side edge of the flat plate-like cathodes 5 and thus in order to inhibit deposition of precipitates on the side edge of the cathodes, the side edges of the flat plate-like anodes 4 and cathodes 5 are spaced from the inner wall of the housing of the electrolytic cell. Although the side edges of the anodes and the cathodes are spaced from the inner wall of the housing, no particular spacing is required and such spacing can be varied as desired. Furthermore, to prevent a decrease in current density at the side edge of the flat plate-like cathodes, the external contour (i.e., the outline of the edges) of the cathodes 5 is located inwardly of the external contour of the anodes 4 so that the electrolyte flowing from the side edge of the anodes 4 will flow perpendicularly toward the side edge of the cathodes 5.

In a conventional vertical electrolytic cell, the flat plate-like anode or cathode is electrically connected by an electrode support plate provided within the electrolytic cell. The provision of the electrode support plate within an electrolytic cell is not desirable because the electrode support plate will form an area where the electrolyte solution tends to stagnate.

Accoding to this invention, an outwardly projecting electric current-passing portion 4' and an outwardly projecting electric current-passing portion 5' are provided at the bottom side edge of each of the anodes 5 and the top side edge of each of the cathodes 5, respectively. These outwardly projecting electric current-passing portions can be made of the same material as the anode and the cathode or can be an integral part thereof. A groove 13 for supporting the cathodes by inserting the electric current-passing portion 5' in the groove is provided at the upper portion of the side wall of the housing, and a groove 14 for supporting the anodes by inserting the electric current-passing portion 4' in the groove is provided at the lower portion of the side wall of the housing. The electric current-passing portion 4' for each anode is connected to an electric current-passing plate 7 inserted between flanges 6, 6' provided outwardly of the groove 14 at the lower portion of the side wall of the housing so as to pass an electric current to each anode. The electric current-passing portion 5' for each cathode is connected to an electric current-passing plate 9 inserted between flanges 8, 8' provided outwardly of the groove 13 at the upper portion of the side wall of the housing so as to pass an electric current to each cathode. The electric current-passing plates 7 and 9 can be made of electrically conductive materials, i.e., metals, and can be welded to the electrodes. Positioning the electric current-passing portion 5' for each cathode at the upper portion of the electrolytic cell is necessary so as to reduce the frequency of direct contact of sea water flowing from the sea water flow inlet with the cathodes, and to minimize the stagnation of sea water on the cathode surface.

Figure 4:
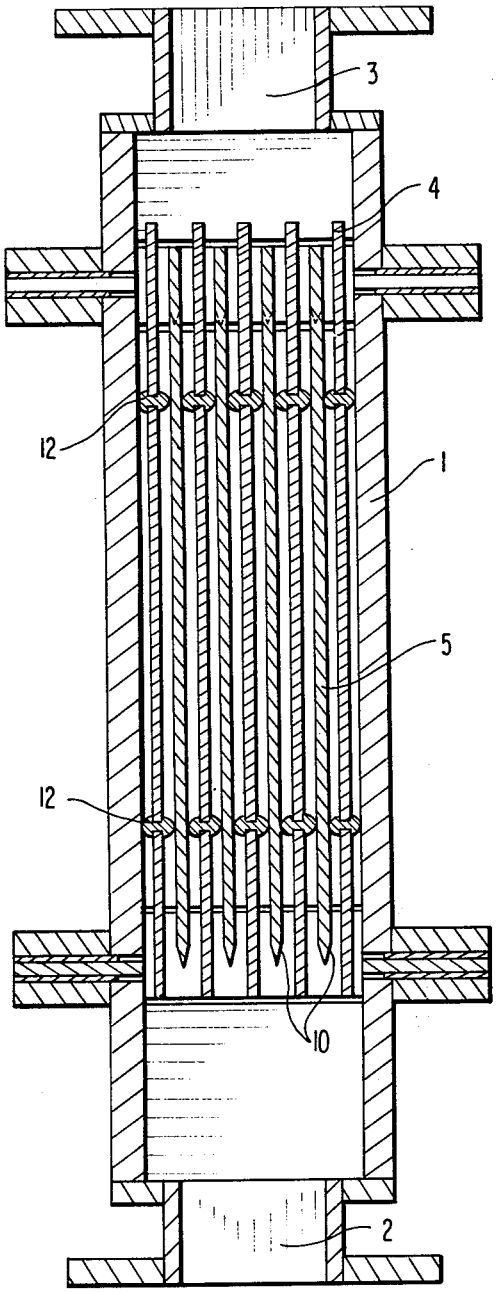
FIG. 4 is a vertical sectional view showing another embodiment of the present invention.
Figure 5:
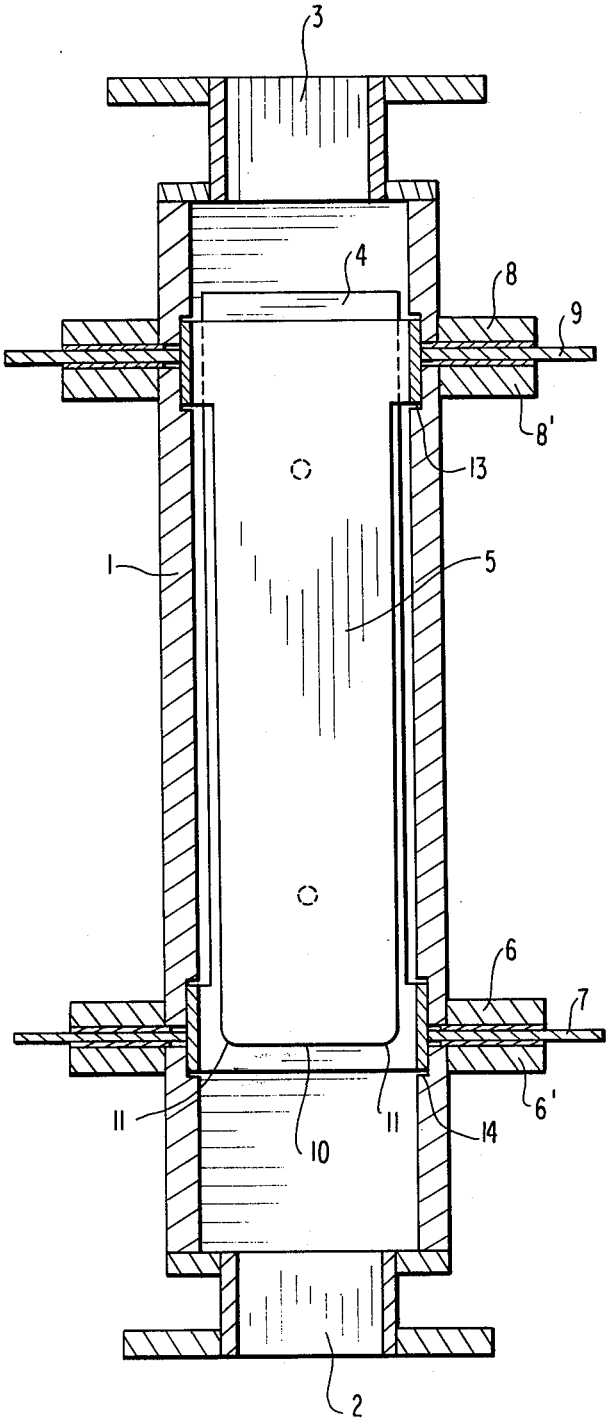
FIG. 5 is a vertical sectional view showing still another embodiment of the present invention.

Another embodiment of the invention is shown in FIG. 4. In FIG. 4 a structure can be employed in which the entire length of a lower end surface 10 of each of the flat plate-like cathodes 5 which faces a sea water flow inlet 2 has an acute-angled wedge shape directed toward the sea water flow inlet 2. The angle at the tip of the wedge shape is less than 90°, preferably less than 30°. With the lower end portion of each of the cathodes having such a wedge shape, the stagnation of sea water is prevented. Furthermore, since there is a localized increase in current density at the end of each of the cathodes, the amount of hydrogen evolved per unit area increases, and the deposition of precipitates at the lower end portion of each of the cathodes can be further prevented due to a stirring effect caused by the liquid and gas Still another embodiment of the invention is shown in FIG. 5. In FIG. 5 both corners 11, 11 in the longitudinal direction of the lower end surface 10 of each of the flat plate-like cathodes 5 are rounded. As the degree of roundness of both corners 11, 11 of the lower end surface 10 of each of the cathodes increases, the area against which the sea water flows decreases, and a greater effect in preventing the formation of precipitates is achieved. Hence, the lower end portion 10 of the cathodes desirably has an arcuate shape.

In order for the interelectrode distance to be maintained constant, a suitable spacer is preferably provided between the anodes and the cathodes.

In the electrolytic cells shown in FIGS. 1 to 5, a hole is provided in the flat plate-like anode, and a rod-like spacer 12 composed of an electrically insulating material such as polyvinyl chloride or polytetrafluoroethylene is inserted in the hole in the anode. Both ends of the spacer are compressed and shaped so as to minimize the area of contact of the spacer with the cathode. The spacer can also be secured to the cathode, but since the cathode is desirably flat, the spacer is preferably secured to the anode.

According to the present invention, the cathodes are plate-like and parallel to the flow of sea water, and the side edges of each of the anodes and each of the cathodes are spaced from the inner wall of the housing of the electrolytic cell. Accordingly, there is no area on the cathode surface where sea water stagnates. Furthermore, since the external contour of the cathodes is located inwardly of the external contour of the anodes, a decrease in current density at the side edge portions of each of the cathodes can be prevented, and deposition of precipitates at the side edge portions of each of the cathodes can be effectively prevented. When the embodiment is employed in which the entire length of the lower end surface of the cathodes which faces the sea water flow inlet has an acute-angled wedge shape directed toward the sea water flow inlet, a localized electric current density increase occurs at the forward end of the lower end portion of each of the cathodes, and the amount of hydrogen gas evolved per unit area increases. Consequently, the deposition of precipitates at the forward end of the lower end portion of each of the cathodes can be prevented due to a stirring effect of liquid and gas. The effect of preventing the deposition of precipitates can be further increased by employing the embodiment in which both corners of the lower end surface of each of the cathodes are rounded.

Even when the electrolytic cell is operated continuously for long periods of time, no accumulation of precipitates occurs on the cathodes, and the operation can be continued in a stable manner.

In use of the electrolytic cell of this invention, sea water (i.e., an aqueous solution containing about 3% NaCl) is electrolyzed to obtain a sodium hypochlorite aqueous solution. In the electrolysis, $Cl_2$ formed at the anode from chloride ions reacts with NaOH formed at the cathode to form NaClO. Suitable electrolysis conditions which can be employed using the electrolytic cell of this invention are described below. These conditions are merely exemplary and are not to be considered as limiting, however.

Electrolysis Conditions

Solution Flow Rate: about 6–24 cm/sec (linear velocity)
Current Density:
Anode: about 5–20 A/dm$^2$
Cathode: about 5–30 A/dm$^2$
Voltage: about 3.5–5.5 V
Interelectrode Distance: about 2–5 mm The present invention is further illustrated more specifically by reference to the following example.

EXAMPLE

Sea water was directly electrolyzed under the following conditions in an electrolytic cell having the same structure as shown in FIGS. 1 to 3 except that the electrolytic cell contained 11 flat plate-like cathodes of titanium and 12 flat plate-like anodes of titanium coated with a layer containing ruthenium oxide and titanium oxide.

Electrolyte Flow Rate: 2 m$^3$/hr
Electrolyte Flow Rate: 6 cm/sec. (linear density)
Interelectrode Distance: 2.5 mm
Current Density at Anode: 10 A/dm$^2$
Current Density at Cathode: 12 A/dm$^2$
Current: 700 A DC The electrolytic cell voltage was maintained at a value between 4.1 and 4.2 V, and about 400 ppm of available chlorine could be obtained in a stable manner at a current efficiency of 80 to 85%. Two months later, the electrolytic cell was disassembled, and the inside of the electrolytic cell was examined. No precipitate deposit was seen. The electrolyte cell was reassembled and operation was further continued. Four months later (6 months from the initiation of operation), the electrolytic cell was again disassembled, and the inside of the electrolytic cell was examined. Scarcely any deposition of precipitate was observed.

Using an electrolytic cell having the structure shown in FIGS. 4 or 5, sea water was directly electrolyzed under the same conditions as described above. After a lapse of six months from the initiation of operation, the electrolytic cell was disassembled, and the inside of the electrolytic cell was examined. No deposition of precipitate was observed.

While the invention has been described in detail and with reference to specific embodiments thereof, it will be apparent to one skilled in the art that various changes and modifications can be made therein without departing from the spirit and scope thereof.

What is claimed is:

1. An electrolytic cell for electrolysis of sea water comprising a housing having an opening at the bottom and top of the housing for in-flow of sea water and out-flow of electrolyzed sea water, respectively;

a plurality of flat plate-like anodes vertically disposed in the housing with the major surface area of the anodes being parallel to the flow of sea water through the cell;

a plurality of flat plate-like cathodes vertically disposed in the housing with the major surface area of the cathodes being parallel to the flow of sea water through the cell;

an outwardly projecting portion for passing an electric current provided at the lower side edge of each of the anodes;

an outwardly projecting portion for passing an electric current provided at the upper side edge of each of the cathodes;

an electric current-passing plate secured to the lower portion of the housing and connected to the portions for passing an electric current to each of the anodes; and an electric current-passing plate secured to the upper portion of the housing and connected to the portions for passing an electric current to each of the cathodes; and wherein the anodes and the cathoes are alternatingly disposed with respect to each other, the side edges of each of the anodes and the side edges of each of the cathodes, except for the portions for passing an electric current of each of the anodes and each of the cathodes, are spaced from the inner wall of the housing, and each of the flat plate-like cathodes and each of the flat plate-like anodes have an external contour such that the external contour of each of the flat plate-like cathodes, except for the portions for passing an electric current to each of the cathodes, is located inwardly of the external contour of each of the flat plate-like anodes.

2. The electrolytic cell set forth in claim 1, wherein the entire length of the lower end surface of each of the flat plate-like cathodes which faces the opening for in-flow of sea water has an acute-angled wedge shape directed toward the opening for in-flow of sea water.

3. The electrolytic cell set forth in claim 1 or 2, wherein each of the flat plate-like cathodes are provided with corners in the longitudinal direction of the lower end surface thereof, and wherein both corners in the longitudinal direction of the lower surface of each of the flat plate-like cathodes facing the opening for in-flow of sea water are rounded.

4. The electrolytic cell set forth in claim 1 or 2, including a spacer provided between each flat plate-like anode and each flat plate-like cathode to maintain the interelectrode distance constant.

5. The electrolytic cell set forth in claim 4, wherein said spacer is inserted into a hole in each flat plate-like anode and the ends of said spacer are shaped so as to minimize the area of contact of said spacer with the cathode.

* * * * *